US008704114B2

(12) United States Patent
Meyer-Haack

(10) Patent No.: US 8,704,114 B2
(45) Date of Patent: Apr. 22, 2014

(54) INTERLOCKED CIRCUIT BREAKERS

(75) Inventor: Wolfgang Meyer-Haack, Neumünster (DE)

(73) Assignee: General Electric Company, Schenectady, NY (US)

( * ) Notice: Subject to any disclaimer, the term of this patent is extended or adjusted under 35 U.S.C. 154(b) by 57 days.

(21) Appl. No.: 13/101,526

(22) Filed: May 5, 2011

(65) Prior Publication Data

US 2012/0279833 A1 Nov. 8, 2012

(51) Int. Cl.
*H01H 9/26* (2006.01)

(52) U.S. Cl.
USPC ..... 200/50.32

(58) Field of Classification Search
USPC ..... 200/50.32, 50.33, 50.35, 5 E, 5 EA
See application file for complete search history.

(56) References Cited

U.S. PATENT DOCUMENTS

| | | | | |
|---|---|---|---|---|
| 1,349,818 | A * | 8/1920 | Coles | 200/50.35 |
| 3,193,646 | A * | 7/1965 | Krebs et al. | 200/50.35 |
| 3,432,628 | A * | 3/1969 | Puetz | 200/50.35 |
| 4,295,053 | A | 10/1981 | Kovatch et al. | |
| 4,295,054 | A * | 10/1981 | Kovatch et al. | 200/50.34 |
| 4,383,146 | A * | 5/1983 | Bur | 200/50.35 |
| 4,384,213 | A | 5/1983 | Bogel | |
| 4,507,703 | A | 3/1985 | Blau et al. | |
| 4,516,100 | A | 5/1985 | Wallace et al. | |
| 4,827,089 | A | 5/1989 | Morris et al. | |
| 4,902,859 | A | 2/1990 | Witzmann et al. | |
| 4,924,041 | A | 5/1990 | Yee | |
| 5,725,085 | A | 3/1998 | Seymour et al. | |
| 5,875,088 | A | 2/1999 | Matsko et al. | |
| 5,965,854 | A * | 10/1999 | Umemura | 200/50.33 |
| 6,593,670 | B2 | 7/2003 | Anderson | |
| 6,989,502 | B1 * | 1/2006 | Lu | 200/50.33 |
| 7,446,271 | B2 | 11/2008 | McCoy | |
| 7,541,900 | B2 * | 6/2009 | Portier | 200/50.32 |
| 7,927,155 | B2 * | 4/2011 | Mittu et al. | 200/50.26 |

FOREIGN PATENT DOCUMENTS

| | | | |
|---|---|---|---|
| DE | 1128906 | B | 5/1962 |
| DE | 102009007585 | A1 | 8/2010 |
| EP | 0103137 | A2 | 3/1984 |
| EP | 1916683 | A1 | 4/2008 |
| EP | 2073231 | A | 6/2009 |

OTHER PUBLICATIONS

Search Report and Written Opinion from EP Application No. 12166474.2, dated Aug. 29, 2012.

* cited by examiner

*Primary Examiner* — Felix O Figueroa
(74) *Attorney, Agent, or Firm* — Cantor Colburn LLP

(57) ABSTRACT

A single module circuit breaker housing includes a first circuit breaker, wherein the first circuit breaker includes a first shaft assembly and a first contact mechanism coupled to the first shaft assembly, a second circuit breaker, wherein the second circuit breaker includes a second shaft assembly and a second contact mechanism coupled to the second shaft assembly, a first linkage coupled to the first shaft assembly and the second contact mechanism, and a second linkage coupled to the second shaft assembly and the first contact mechanism.

17 Claims, 6 Drawing Sheets

INTERLOCKED CIRCUIT BREAKERS

BACKGROUND OF THE INVENTION

The subject matter disclosed herein relates to circuit breakers. Particularly, example embodiments are directed to interlocked circuit breakers in a single module housing.

BRIEF DESCRIPTION OF THE INVENTION

According to an example embodiment of the present invention, a single module circuit breaker housing includes a first circuit breaker, wherein the first circuit breaker includes a first shaft assembly and a first contact mechanism coupled to the first shaft assembly, a second circuit breaker, wherein the second circuit breaker includes a second shaft assembly and a second contact mechanism coupled to the second shaft assembly, a first linkage coupled to the first shaft assembly and the second contact mechanism, and a second linkage coupled to the second shaft assembly and the first contact mechanism.

According to an additional example embodiment, a single module circuit breaker housing includes a first circuit breaker, wherein the first circuit breaker includes a first shaft assembly and a first contact mechanism coupled to the first shaft assembly, a second circuit breaker, wherein the second circuit breaker includes a second shaft assembly and a second contact mechanism coupled to the second shaft assembly, and a pivot mechanism coupled to the first shaft assembly, the second shaft assembly, the first contact mechanism, and the second contact mechanism. According to the example embodiment, if the first contact mechanism is in a closed position, the pivot mechanism mechanically disables the second contact mechanism, and if the second contact mechanism is in a closed position, the pivot mechanism mechanically disables the first contact mechanism.

According to an additional example embodiment, an interlocked circuit breaker system includes a first single module circuit breaker housing and a second single module circuit breaker housing. The first single module circuit breaker housing includes a first circuit breaker, wherein the first circuit breaker includes a first shaft assembly and a first contact mechanism coupled to the first shaft assembly, a second circuit breaker, wherein the second circuit breaker includes a second shaft assembly and a second contact mechanism coupled to the second shaft assembly, a first linkage coupled to the first shaft assembly and the second contact mechanism, a second linkage coupled to the second shaft assembly and the first contact mechanism, and a third linkage coupled to the first linkage and the second linkage. According to the example embodiment, the second single module circuit breaker housing includes a third circuit breaker, wherein the third circuit breaker includes a third shaft assembly and a third contact mechanism coupled to the third shaft assembly and the third linkage.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Example embodiments of the present invention are directed to interlocked circuit breakers. For example, interlocked circuit breakers as described herein include at least two independent circuit breakers within a single module housing with mechanical interlocking linkages and/or pivot mechanisms arranged between both circuit breakers. The mechanical interlocking linkages and/or pivot mechanisms may include a single link or multiple links, which, in response to a first circuit breaker of the interlocked circuit breakers being closed, disables all other circuit breakers of the interlocked circuit breakers. Furthermore, the mechanical interlocking linkages and/or pivot mechanisms may include an externally communicating linkage which when arranged to be mechanically coupled to a separate circuit breaker or separate interlocked circuit breakers, disables all other circuit breakers of the interlocked circuit breakers and separate circuit breaker in response to one circuit breaker being closed.

Hereinafter, example embodiments are described in detail.

Figure 1:
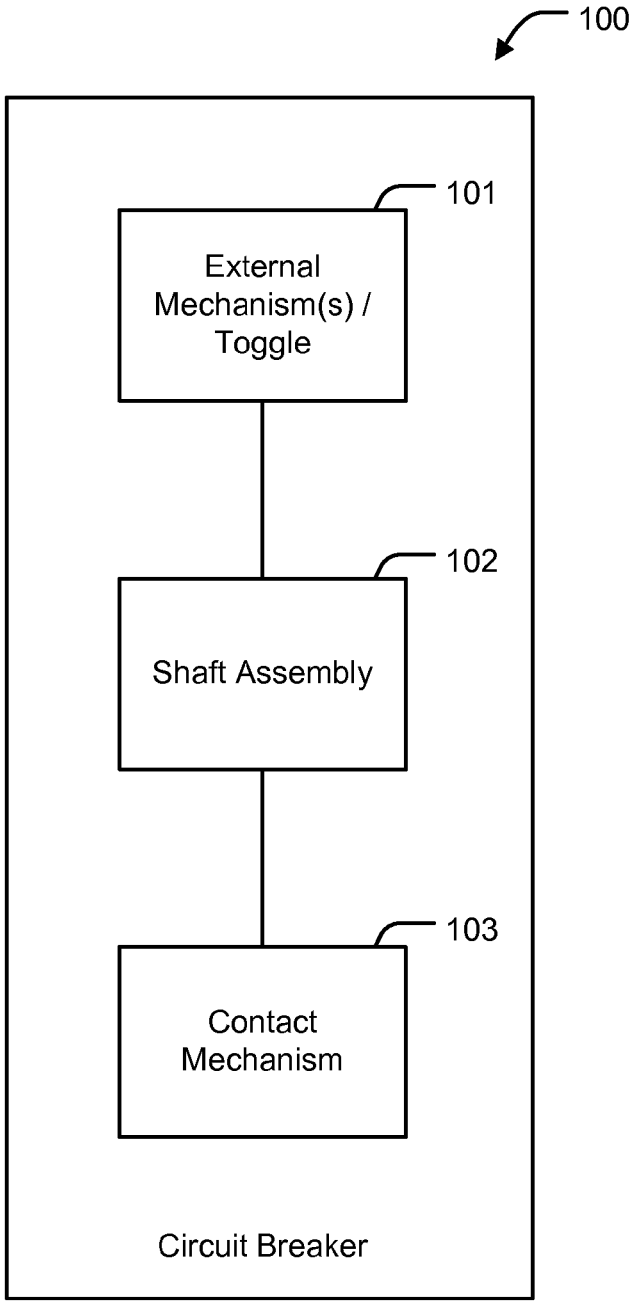
FIG. 1 depicts a circuit breaker.

Conventionally, circuit breakers are individually housed in separate housings. FIG. 1 depicts an example circuit breaker housed in an individual housing. As illustrated, the circuit breaker 100 includes external mechanism 101. The external mechanism 101 may be a toggle, switch, or any similar mechanism. The circuit breaker 100 further includes shaft assembly 102 coupled to the external mechanism 101. The shaft assembly 102 may be a layshaft assembly and/or linkage. The circuit breaker 100 further includes contact mechanism 103 coupled to layshaft assembly 102. The contact mechanism 103 may be a mechanism arranged and configured to open/close contacts of the circuit breaker 100.

Figure 6:
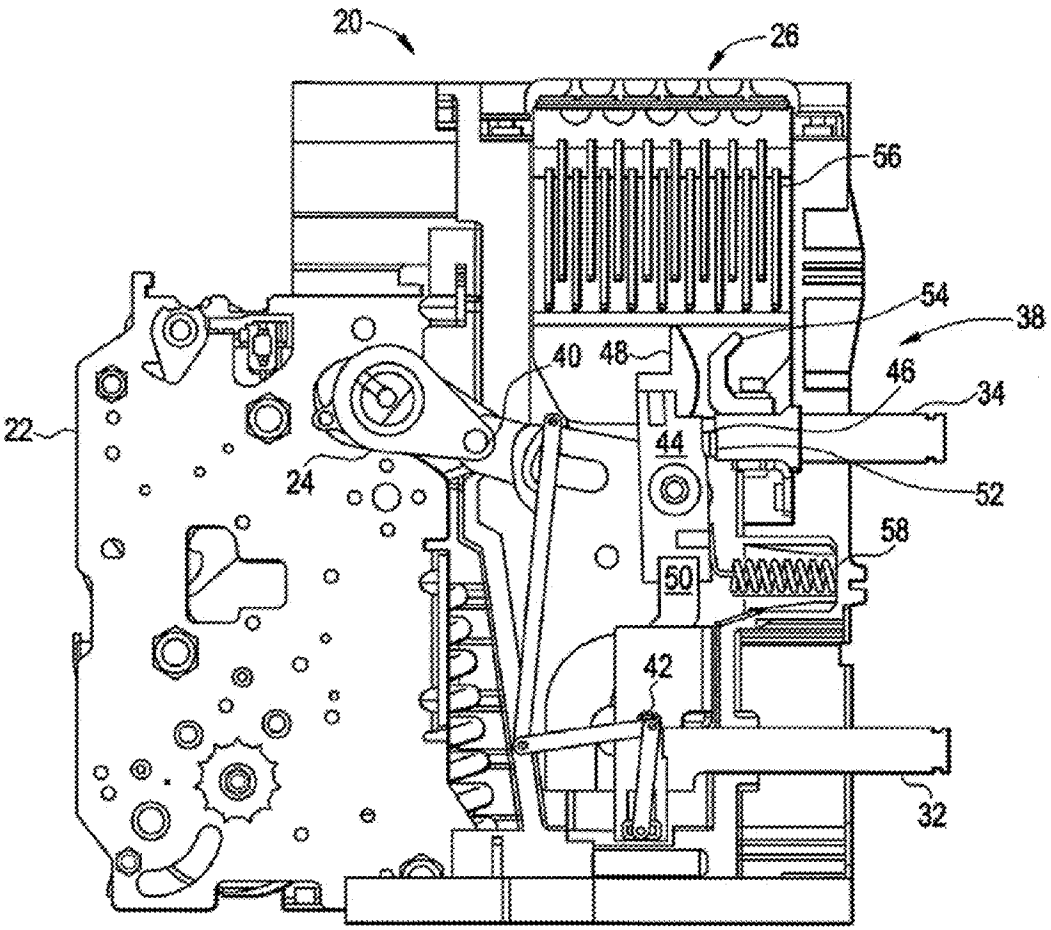
FIG. 6 (Prior Art)
FIG. 6 depicts a circuit breaker according to the prior art.

With reference to FIG. 6, to depict exemplary components of a circuit breaker, an exemplary circuit breaker 20 is shown, as described in U.S. Pat. No. 7,911,302. The circuit breaker 20 is a multi-pole circuit breaker and includes a main mechanism 22 and a lay shaft assembly 24 that couples the mechanism 22 to pole assemblies, including pole assembly 26 shown in the closed position. The mechanism 22 provides a means for an operator to open, close and reset the pole assemblies and will typically include an operator interface. The mechanism will further include a trip unit that detects undesired electrical conditions and upon sensing of such a condition activates the mechanism 22. The pole assemblies, including pole assembly 26, conduct electrical current through the circuit breaker 20 and provide the means for connecting and disconnecting the protected circuit from the electrical power source. The pole assembly 26 is coupled to a pair of conductors 32, 34 that connects the circuit breaker 20 to the protected load and the electrical power source. The lay shaft assembly 24 is coupled to a contact arm assembly 38 through a pin 40 and transfers energy from the mechanism 2 that is necessary to open and close a contact arm 44. The contact arm assembly 38 is mounted in the circuit breaker 20 to pivot about a pin 42 to move between a closed, an open and a tripped position. The contact arm has a movable contact 46 and an arcing contact 48 mounted to one end. A flexible, electrically conductive strap 50, made from braided copper cable for example, is attached to the opposite end of the movable contact 46. The flexible strap 50 electrically couples the contact arm 44 to the conductor 32 that allows electrical current to flow through the circuit breaker 20. The electrical current flow through the contact arm assembly 38 and exits via movable contact 46. The current then passes through stationary contact 52 and into conductor 34 where it is transmitted to the load. Another arcing contact 54 is mounted to the conductor 34. The arcing contacts 48, 54 assist the circuit breaker 20 in moving any electrical arc formed when the contact arm 44 is opened into an arc chute 56. A compression spring 58 is mounted to the circuit breaker 20 to exert a force on the bottom side of the contact arm 44 and assist with the opening of the contact arm assembly 38.

As each of the external mechanism 101, shaft assembly 102, and contact mechanism 103 are coupled, it should be understood that manipulation of the external mechanism 101 will cause opening/closing of contacts within the contact mechanism 103. Further, in the event of an over-current condition, it should be understood that forced opening of the contacts within the contact mechanism 103 will cause the external mechanism 101 to toggle to a position indicating the contacts are in an open position.

In certain applications, it is desirable to interlock two or more circuit breakers, for example circuit breakers similar to circuit breaker 100, to enable lock-out or disabling of a set of the interlocked circuit breakers. For example, in some instances a main power source and a backup power source may be available. In this example, a first circuit breaker may be arranged for protective operation of power from the main power source, and a second circuit breaker may be arranged for protective operation of power from the backup power source. It follows that should the main power source and first circuit breaker be active/closed, the second circuit breaker should be disabled, thereby negating the possibility for the two power sources to be simultaneously providing power. If the first and second circuit breakers are properly interlocked, it follows that operation of either circuit breaker disables operation of the remaining circuit breaker, thereby providing this functionality.

However, conventional interlocking techniques involve complicated external mechanisms and/or cabling to interlock separate circuit breakers. These external interlocking systems are separate from both breakers, and are prone to failure and/or errors in installation which may cause improper interlocking. Furthermore, these external interlocking systems may attempt to physically force separation of the contacts of the circuit breaker to be disabled, rather than actually disable the circuit breaker; this may cause further issues and prove prone to failure.

Example embodiments of the present invention overcome these drawbacks.

Figure 2:
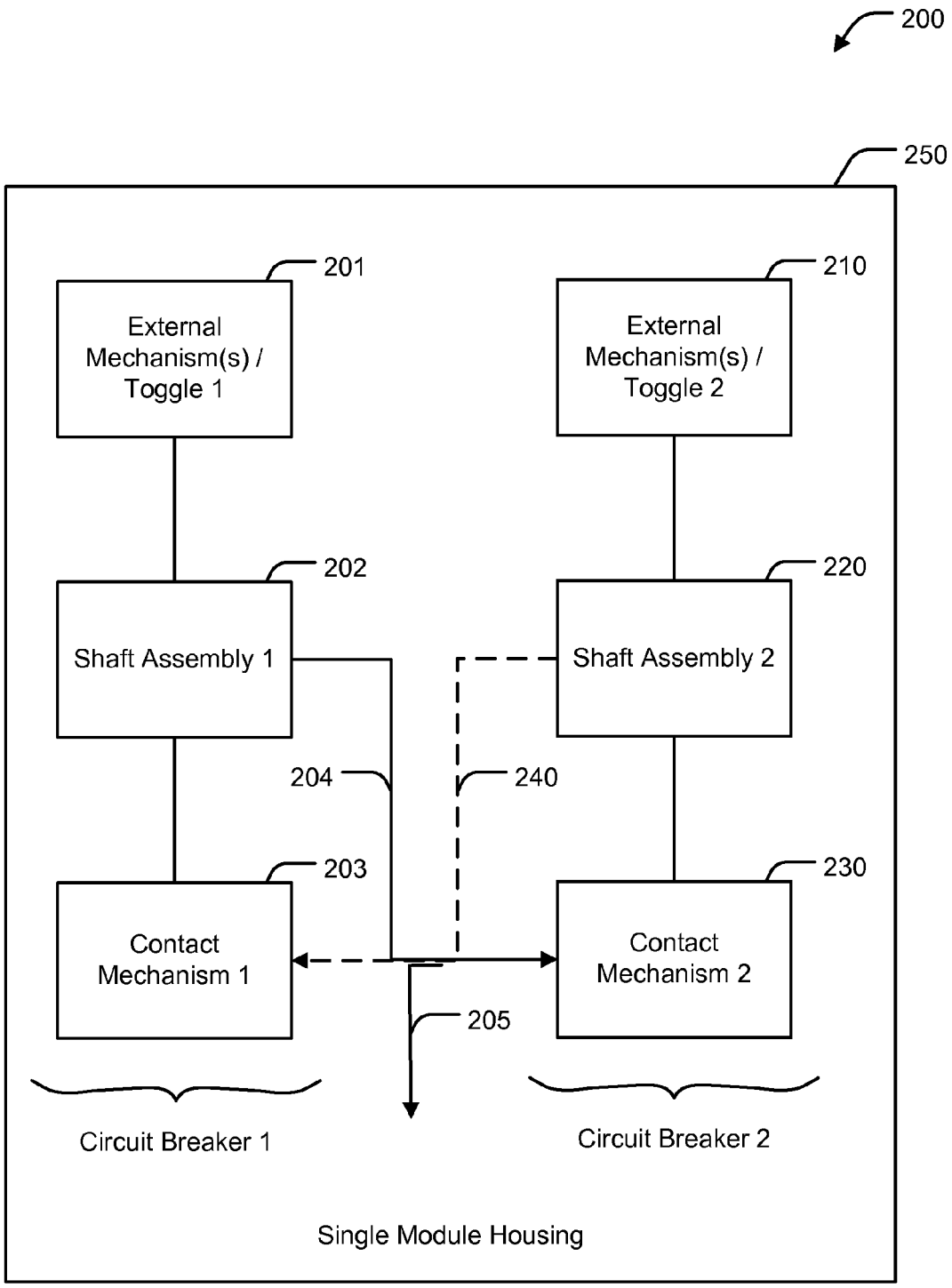
FIG. 2 depicts interlocked circuit breakers, according to an example embodiment.

FIG. 2 depicts interlocked circuit breakers within a single module housing, according to an example embodiment. As illustrated, the interlocked circuit breakers 200 are housed within a single module housing 250, as further shown in FIG. 5. The single module housing 250 may be a housing sized and configured to be arranged as a single module circuit breaker. For example, the single module housing 250 may easily be arranged on a backboard, circuit breaker terminal arrangement, or other arrangement means as a single circuit breaker, albeit including two interlocked circuit breakers therein.

The interlocked circuit breakers 200 include a first circuit breaker and a second circuit breaker, circuit breaker 1 and circuit breaker 2, respectfully. The first circuit breaker includes external mechanism 201. The external mechanism 201 may be a toggle, switch, or any similar mechanism. The first circuit breaker further includes shaft assembly 202 coupled to the external mechanism 201. The shaft assembly 202 may be a layshaft assembly and/or linkage. The first circuit breaker further includes contact mechanism 203 coupled to layshaft assembly 202. The contact mechanism 203 may be a mechanism arranged and configured to open/close contacts of the first circuit breaker.

As each of the external mechanism 201, shaft assembly 202, and contact mechanism 203 are coupled, it should be understood that manipulation of the external mechanism 201 will cause opening/closing of contacts within the contact mechanism 203. Further, in the event of an over-current condition, it should be understood that forced opening of the contacts within the contact mechanism 203 will cause the external mechanism 201 to toggle to a position indicating the contacts are in an open position.

Turning back to FIG. 2, the second circuit breaker includes external mechanism 210. The external mechanism 210 may be a toggle, switch, or any similar mechanism. The second circuit breaker further includes shaft assembly 220 coupled to the external mechanism 210. The shaft assembly 220 may be a layshaft assembly and/or linkage. The second circuit breaker further includes contact mechanism 230 coupled to layshaft assembly 220. The contact mechanism 230 may be a mechanism arranged and configured to open/close contacts of the second circuit breaker.

As each of the external mechanism 210, shaft assembly 220, and contact mechanism 230 are coupled, it should be understood that manipulation of the external mechanism 210 will cause opening/closing of contacts within the contact mechanism 230. Further, in the event of an over-current condition, it should be understood that forced opening of the contacts within the contact mechanism 230 will cause the external mechanism 210 to toggle to a position indicating the contacts are in an open position.

Turning back to FIGS. 2 and 5, the single module housing 250 further includes first linkage 204 and second linkage 240 arranged therein. The first linkage 204 is coupled between the shaft assembly 202 of the first circuit breaker, and the contact mechanism 230 of the second circuit breaker. Movement of the shaft assembly 202 is mechanically communicated to the contact mechanism 230 through the first linkage 204. When the shaft assembly 202 is in a closed position (e.g., contact mechanism 203 is in the closed position), the contact mechanism 230 is disabled through an internal means. For example, the contact mechanism 230 may include a "kiss-free" mechanism through which disablement of the contact mechanism 230 is enacted. When disabled, the contact mechanism 230 does not allow closing of the contacts arranged therein. In this manner, if the first circuit breaker is arranged to be closed, operation of the second circuit breaker is not possible, thus providing interlocking communication from the first circuit breaker to the second circuit breaker.

It is readily understood that the functionality provided by the first linkage 204 enacts a disabling operation of the second circuit breaker only. However, the second linkage 240 provides additional functionality which completes interlocking between the first and second circuit breakers.

As illustrated, the second linkage 240 is coupled between the shaft assembly 220 of the second circuit breaker, and the contact mechanism 203 of the first circuit breaker. Movement of the shaft assembly 220 is mechanically communicated to the contact mechanism 203 through the second linkage 240. When the shaft assembly 220 is in a closed position (e.g., contact mechanism 230 is in the closed position), the contact mechanism 203 is disabled through an internal means. For example, the contact mechanism 203 may include a "kiss-free" mechanism through which disablement of the contact mechanism 203 is enacted. When disabled, the contact mechanism 203 does not allow closing of the contacts arranged therein. In this manner, if the second circuit breaker is arranged to be closed, operation of the first circuit breaker is not possible, thus providing interlocking communication from the second circuit breaker to the first circuit breaker.

As described above, closing of either the first or second circuit breakers arranged within the single module housing 250 disables operation of the remaining circuit breaker. It is understood that if the first circuit breaker is closed before the second circuit breaker, the contact mechanism 230 is disabled. Further, as the contact mechanism 230 is disabled, and is also mechanically coupled to shaft assembly 220, operation of the shaft assembly 220 is also disabled, thereby negating the possibility of disablement of the contact mechanism 203. More clearly, if the second circuit breaker is disabled through the first linkage 204, the second linkage 240 does not disable the contact mechanism 203, even when toggling is attempted at the external mechanism 210.

Furthermore, it is understood that if the second circuit breaker is closed before the first circuit breaker, the contact mechanism 203 is disabled. Further, as the contact mechanism 203 is disabled, and is also mechanically coupled to shaft assembly 202, operation of the shaft assembly 202 is also disabled, thereby negating the possibility of disablement of the contact mechanism 203. More clearly, if the first circuit breaker is disabled through the second linkage 240, the first linkage 204 does not disable the contact mechanism 230, even when toggling is attempted at the external mechanism 201.

Although described as separate linkages, the first linkage 204 and the second linkage 240 may be mechanically coupled. For example, the first linkage 204 and the second linkage 240 may be embodied as a pivot mechanism 260 formed of the two linkages 204, 240. This pivot mechanism 260 may be arranged and/or supported on a wall or portion of the single module housing 250.

As this pivot mechanism 260 is internally supported within the single module housing 250 and integrally arranged between respective shaft assemblies and contact mechanisms of the first and second circuit breakers, it should be understood that faulty operation may be reduced when compared to conventional, external cabling and mechanical interlocking.

Furthermore, as this pivot mechanism 260 is internally supported within the single module housing 250 and integrally arranged between respective shaft assemblies and contact mechanisms of the first and second circuit breakers, it should be understood that deployment of the interlocked circuit breakers 200 is relatively easy, as no external manipulation of internal components is necessary.

Turning back to FIGS. 2 and 5, the single module housing 250 may further include a third linkage 205 coupled to the first linkage 204 and the second linkage 240. It is noted that the third linkage 205 is an optional linkage. The third linkage 205 may be arranged to communicate mechanical movement of the first linkage 104 and the second linkage 240 externally, for example to a separate circuit breaker. This external mechanical communication is described more fully with reference to FIG. 4.

Although described above as being mechanically interlocked, the interlocked circuit breakers 200 are not so limited. For example, a plurality of different electrical interlocks may be employed either alone, or in combination, with the above-described mechanical interlocking examples.

Figure 3:
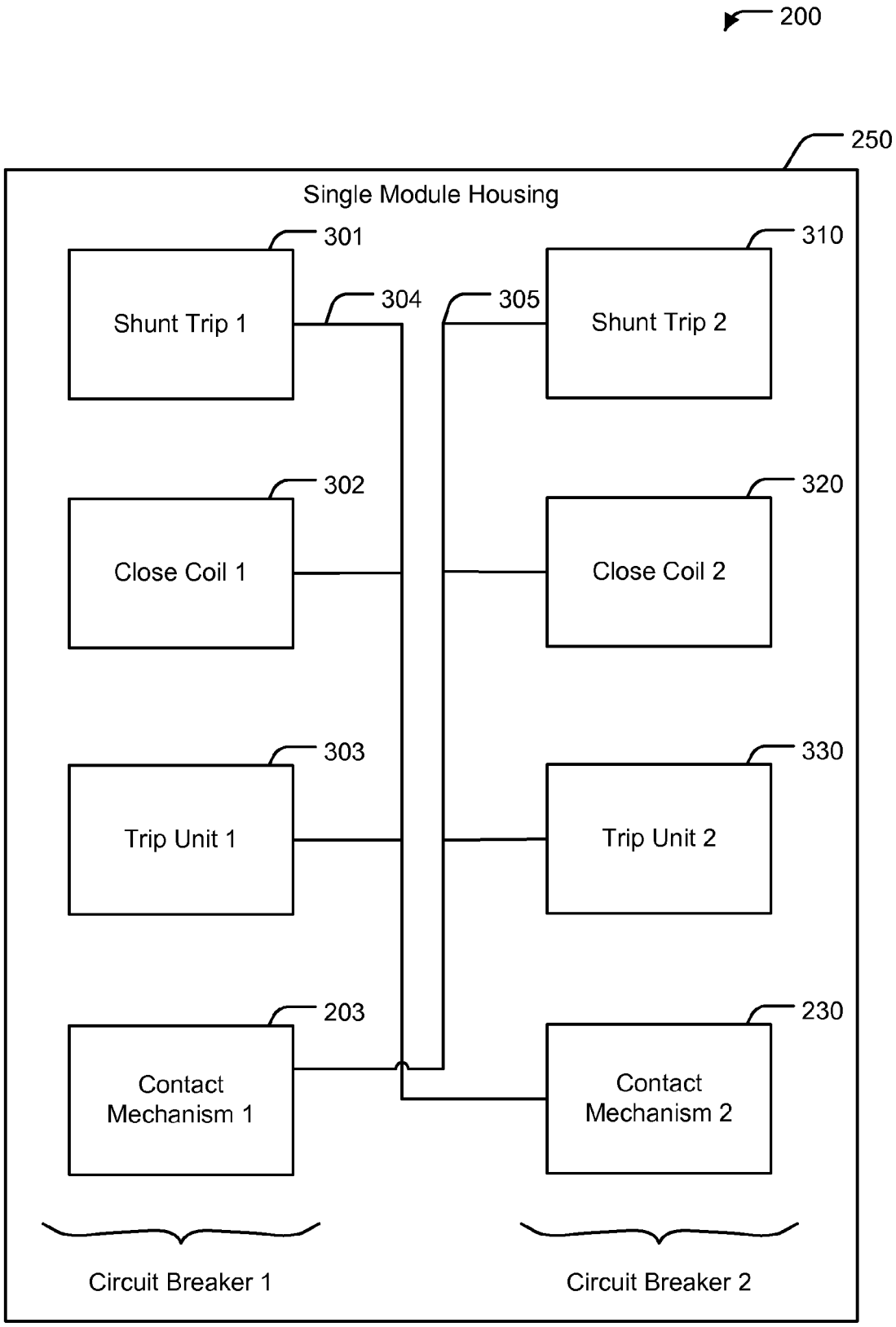
FIG. 3 depicts interlocked circuit breakers, according to an example embodiment.
Figure 5:
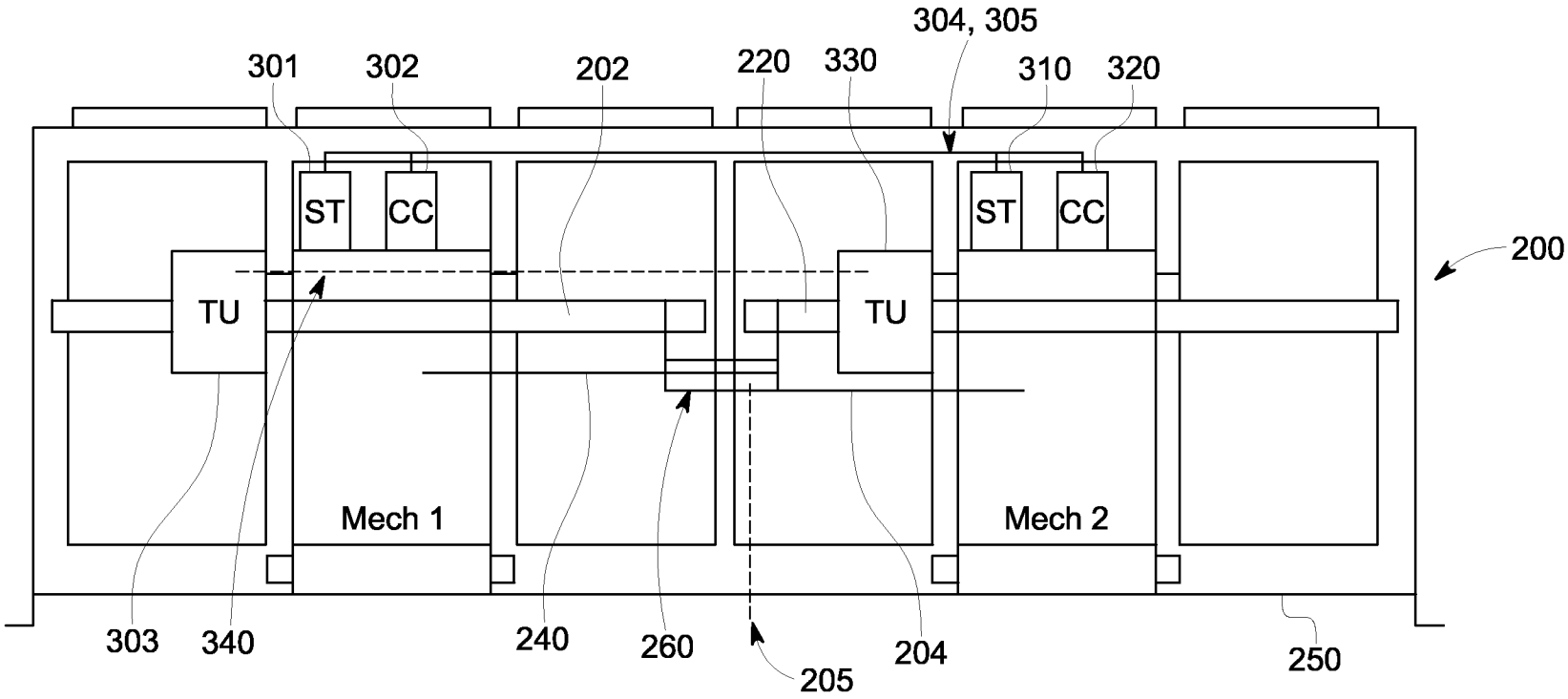
FIG. 5 depicts interlocked circuit breakers, according to an example embodiment.

For example, FIGS. 3 and 5 depict interlocked circuit breakers, according to an example embodiment. As illustrated, the interlocked circuit breakers 200 include a plurality of electrical portions which may be interlocked through electrical communication mediums with feedback regarding a state of an opposing circuit breaker's contact position.

The first circuit breaker includes a shunt trip portion 301. The shunt trip portion 301 may include a shunt trip magnetic coil arranged to trip, or open, the first circuit breaker. The shunt trip portion 301 may be in electrical communication with the second circuit breaker over electrical communication medium 304. Further, the second circuit breaker may include shunt trip portion 310 in communication with the first circuit breaker over electrical communication medium 305. The shunt trip portion 310 may be structurally and functionally similar to the shunt trip portion 301. The electrical communication mediums 304 and 305 may be any suitable mediums configured to transmit an electrical signal indicative of the state of either of the first and circuit breakers between the shunt trip portion 301 and the shunt trip portion 310. The indicative electrical signal may be momentary, transitory, and/or a fixed signal. The indicative signal may disable and/or override either circuit breaker in response to the other circuit breaker being closed. In this manner, the first and second circuit breakers may be electrically interlocked.

The first circuit breaker further includes a close coil portion 302. The close coil portion 302 may include a coil arranged to activate, or close, the first circuit breaker. The close coil portion 302 may be in electrical communication the second circuit breaker over electrical communication medium 304. The second circuit breaker may further include close coil portion 320 in communication with the first circuit breaker over electrical communication medium 305. The close coil portion 320 may be structurally and functionally similar to the close coil portion 302. In addition to that described above, the electrical communication mediums 304 and 305 may be any suitable mediums configured to transmit an electrical signal indicative of the state of either of the first and circuit breakers between the close coil portion 302 and the close coil portion 320. Furthermore, although illustrated as a single medium, it should be understood that there may be provided separate mediums for communication of each portion of the first and second circuit breakers. In this manner, the first and second circuit breakers may be electrically interlocked.

The first circuit breaker further includes a trip unit 303. The trip unit 303 may be configured to trip, or open, the first circuit breaker. The trip unit 303 may be in electrical communication with the second circuit breaker over electrical communication medium 304. Further, the second circuit breaker may include trip unit 330 in communication with the first circuit breaker over electrical communication medium 305. The trip unit 330 may be functionally similar to the trip unit 303. In addition to that described above, the electrical communication mediums 304 and 305 may be any suitable mediums configured to transmit an electrical signal indicative of the state of either of the first and circuit breakers between the trip unit 303 and the trip unit 330. The indicative electrical signal may be momentary, transitory, and/or a fixed signal. In response to activation or deactivation or either the first or second circuit breakers, the opposing trip units override or take over control of the interlocked circuit breaker.

Alternatively, there may be provided a separate or distinct communication medium 340 between the trip units 303 and 330 themselves, and/or between each trip unit and the opposing circuit breaker's contact mechanisms. These electrical communication mediums 340 may be configured as a serial, CAN bus, or other communication bus. Therefore, the electrical communication mediums may provide other information regarding the status of either circuit breaker. For example, the electrical communication medium may provide information regarding current and/or overcurrent conditions, information from external processors and/or computer apparatuses, and any other suitable information. This information may disable either circuit breaker in response to the other circuit breaker being closed or activated. Furthermore, these communication mediums may be configured to allow the override as described above and in more detail below.

Regarding circuit breaker override, each circuit breaker may be configured or disposed to receive an input(s) from a user or external unit directing that circuit breaker to activate. In response to the input, the receiving circuit breaker transmits the information to the opposing circuit breaker facilitating deactivation and transfer/override of control.

For example, if the first circuit breaker is active and an input is received at the second circuit breaker indicative of an activation request, the second circuit breaker communicates the request to the first circuit breaker, the first circuit breaker relinquishes control, and the second circuit breaker assumes control. This functionality may be implemented with predetermined or desired time delays or any other desired additions. In a different scenario, for example if the first circuit breaker trips, the trip information is transmitted to the second circuit breaker allowing for the second circuit breaker to assume control. The activation requests and circuit breaker status information may be transmitted between trip units. Further, it should be understood that either the trip unit of each respective breaker or an electronic control portion of each respective circuit breaker assumes control/overrides the opposing breaker.

Furthermore, given the electrical communication between both the first and second circuit breakers, trip unit 303 may be configured to trip one or both the first and second circuit breakers. The same is true for trip unit 330. For example if the first circuit breaker detects a down stream ground fault, transfer of control to the second circuit breaker may not be appropriate. Thus tripping of both breakers may be beneficial. Thus, example embodiments of the present invention may provide preventive blocking.

Therefore, as described above, example embodiments provide novel interlocking means to effectively interlock two or more circuit breakers housed in a single module housing. The interlocking means may include mechanical interlocking pivot mechanisms, linkages, electrical communication channels, and/or any other suitable interlocking means. Each of the above-disclosed interlocking means may be used singularly, or in any suitable combination. For example, the first and second linkages 204 and 240 may be arranged to mechanically interlock the first and second circuit breakers, and additional electrical interlocks may be provided between shunt trip portions, close coil portions, and/or trip units of the first and second circuit breakers. Thus, example embodiments provide interlocking means which reduce faulty interlock operation between circuit breakers.

Figure 4:
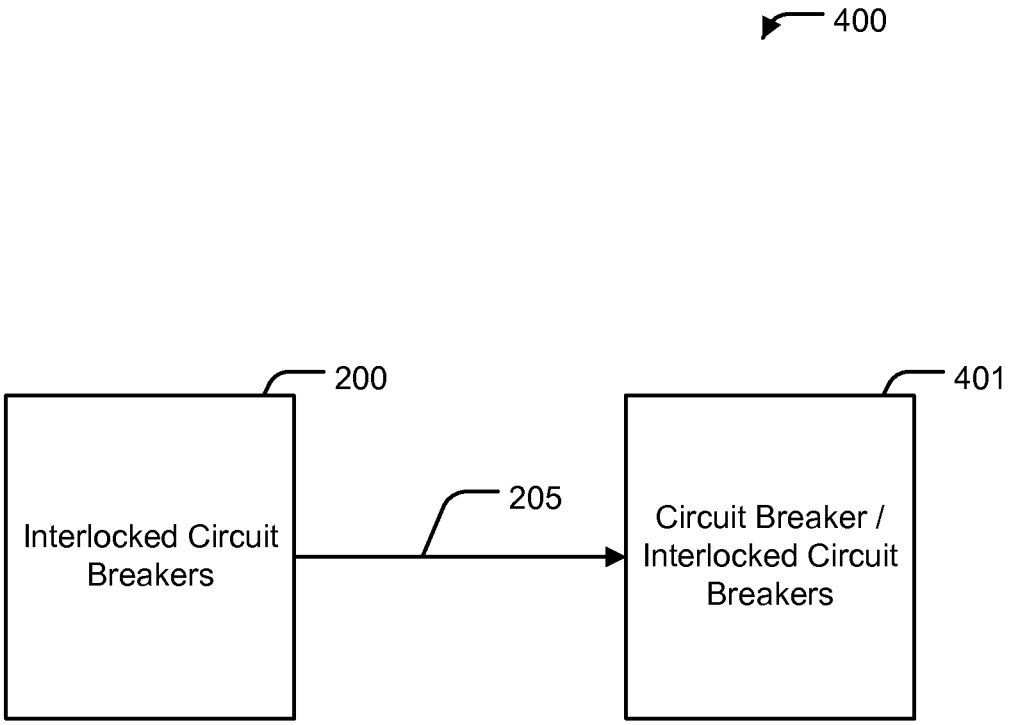
FIG. 4 depicts an interlocked circuit breaker system, according to an example embodiment.

Furthermore, although the above example embodiments have been described with interlocking between two or more circuit breakers housed in a single module housing, the same may be extended across multiple single module housings through the use of the third linkage 205, described above. For example, FIG. 4 depicts an interlocked circuit breaker system including more than one single module housing, according to an example embodiment.

As illustrated, the interlocked circuit breakers 200 may be coupled to a single module housing 401 with the third linkage 205. The single module housing 401 may include one circuit breaker; or two or more interlocked circuit breakers, for example, arranged similarly as the interlocked circuit breakers 200.

According to at least one example embodiment, the single module housing 401 includes a single circuit breaker somewhat similar to the circuit breaker 100 of FIG. 1. The third linkage 205 may be mechanically coupled to the contact mechanism of the circuit breaker housed in single module housing 401, thereby disabling operation of this circuit breaker. Furthermore, the same may be mechanically communicated from the single module housing 401 to the interlocked circuit breakers 200. For example, if the circuit breaker of the single module housing 401 is activated or closed, the third linkage 205 may disable operation of both interlocked circuit breakers 200. In this manner, the entire circuit breaker system 400 is mechanically interlocked. Furthermore, one or more of closed loop coil portions, shunt trip coil portions, and trip units of circuit breakers of the system 400 may also be electrically interlocked, thereby facilitating electrical interlocking across the entire circuit breaker system 400.

According to another example embodiment, the single module housing 401 may include two or more interlocked circuit breakers. These two or more interlocked circuit breakers may be arranged similarly to the interlocked circuit breakers 200. Therefore, the third linkage 205 may be mechanically coupled to an external linkage of the interlocked circuit breakers housed in single module housing 401, thereby disabling operation of these interlocked circuit breakers. Furthermore, the same may be mechanically communicated from the single module housing 401 to the interlocked circuit breakers 200. For example, if either interlocked circuit breaker of the single module housing 401 is activated or closed, the third linkage 205 may disable operation of both interlocked circuit breakers 200. In this manner, the entire circuit breaker system 400 is mechanically interlocked. Furthermore, one or more of closed loop coil portions, shunt trip coil portions, and trip units of circuit breakers of the system 400 may also be electrically interlocked, thereby facilitating electrical interlocking across the entire circuit breaker system 400.

Thus, as described above, example embodiments provide interlocked circuit breaker systems which may be deployed with relative ease, thereby facilitating a reduced possibility of faulty operation. The interlocked circuit breaker systems may be mechanically and/or electrically interlocked.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A single module circuit breaker housing, comprising:

a first circuit breaker disposed within the single module circuit breaker housing, wherein the first circuit breaker includes a first shaft assembly, a first contact mechanism coupled to the first shaft assembly, and contacts within the first contact mechanism arranged to be forced open by an over-current condition;

a second circuit breaker disposed within the single module circuit breaker housing, wherein the second circuit breaker includes a second shaft assembly, a second contact mechanism coupled to the second shaft assembly, and contacts within the second contact mechanism arranged to be forced open by an over-current condition;

a first linkage coupled to the first shaft assembly and the second contact mechanism, the first linkage disposed within the single module circuit breaker housing; and a second linkage coupled to the second shaft assembly and the first contact mechanism, the second linkage disposed within the single module circuit breaker housing;

wherein the single module circuit breaker housing encloses a space, the first circuit breaker, second circuit breaker, first linkage, and second linkage configured to share the space enclosed by the single module circuit breaker housing, the single module circuit breaker housing configured to be arranged as a single module circuit breaker, and the single module circuit breaker housing with the first and second circuit breakers interlocked within the single module circuit breaker housing configured to be arranged as a unit on a backboard; and the first circuit breaker further includes a first trip unit configured to trip the first contact mechanism; and the second circuit breaker further includes a second trip unit in electrical communication with the first trip unit, and configured to trip the second contact mechanism.

2. The housing of claim 1, wherein if the first circuit breaker is in a closed position, the second contact mechanism is disabled.

3. The housing of claim 1, wherein if the second circuit breaker is in a closed position, the first contact mechanism is disabled.

4. The housing of claim 1, wherein the first linkage is configured to mechanically disable the second contact mechanism.

5. The housing of claim 1, wherein the second linkage is configured to mechanically disable the first contact mechanism.

6. The housing of claim 1, wherein the first linkage is coupled to the second linkage to form a pivot mechanism between the first shaft assembly, the second shaft assembly, the first contact mechanism, and the second contact mechanism, the pivot mechanism disposed within the single module circuit breaker housing.

7. The housing of claim 1, wherein:

the first circuit breaker further includes a first shunt trip portion in electrical communication with the second circuit breaker; and the second circuit breaker further includes a second shunt trip portion in electrical communication with the first circuit breaker.

8. The housing of claim 7, wherein the first shunt trip portion is configured to electrically disable the second shunt trip portion.

9. The housing of claim 7, wherein the second shunt trip portion is configured to electrically disable the first shunt trip portion.

10. The housing of claim 1, wherein:

the first circuit breaker further includes a first close coil portion in electrical communication with the second circuit breaker; and the second circuit breaker further includes a second close coil portion in electrical communication with the first circuit breaker.

11. The housing of claim 10, wherein the first close coil portion is configured to electrically disable the second close coil portion.

12. The housing of claim 10, wherein the second close coil portion is configured to electrically disable the first close coil portion.

13. The housing of claim 1, wherein the first trip unit is configured to override the second trip unit.

14. The housing of claim 1, wherein the second trip unit is configured to override the first trip unit.

15. The housing of claim 1, further comprising a third linkage coupled to the first linkage and the second linkage, wherein a portion of the third linkage extends exteriorly of the single module circuit breaker housing.

16. The housing of claim 1, wherein the first and second linkages are disposed entirely within the single module circuit breaker housing.

17. The housing of claim 1, wherein the first shaft assembly, first contact mechanism, second shaft assembly, and second contact mechanism are disposed within the single module circuit breaker housing.

* * * * *